US007051616B2

(12) United States Patent
Yokochi et al.

(10) Patent No.: US 7,051,616 B2
(45) Date of Patent: May 30, 2006

(54) ACCELERATOR DEVICE

(75) Inventors: Tsuneyuki Yokochi, Obu (JP); Ryuji Kosugi, Obu (JP); Yasunori Yamada, Obu (JP); Akihito Kuno, Obu (JP)

(73) Assignee: Aisan Kogyo Kabushiki Kaisha, Obu (JP)

( * ) Notice: Subject to any disclaimer, the term of this patent is extended or adjusted under 35 U.S.C. 154(b) by 340 days.

(21) Appl. No.: 10/419,074

(22) Filed: Apr. 21, 2003

(65) Prior Publication Data

US 2003/0226419 A1 Dec. 11, 2003

(30) Foreign Application Priority Data

Jun. 5, 2002 (JP) ..... 2002-164132

(51) Int. Cl.
*G05G 1/14* (2006.01)

(52) U.S. Cl. ..... 74/513

(58) Field of Classification Search ..... 74/512–514, 74/560; 338/153; 200/61.89; 267/154, 267/156, 272; 123/399; 701/1
See application file for complete search history.

(56) References Cited

U.S. PATENT DOCUMENTS 5,768,946 A * 6/1998 Fromer et al. ..... 74/514
5,934,152 A * 8/1999 Aschoff et al. ..... 74/513
6,626,061 B1 * 9/2003 Sakamoto et al. ..... 74/512
6,834,564 B1 * 12/2004 Huesges et al. ..... 74/513

FOREIGN PATENT DOCUMENTS

JP A 2002-79844 3/2002

* cited by examiner

*Primary Examiner*—Chong H. Kim
(74) *Attorney, Agent, or Firm*—Oliff & Berridge, PLC

(57) ABSTRACT

An accelerator device includes an accelerator arm 12 provided with an accelerator pedal 11, a support case 13 internally holding and supporting an arm base part 12*a* through a support shaft 14, a return spring 16 and 17 for urging the arm 12 to rotate in a returning direction to return the pedal 11 to an initial position, and an accelerator sensor 15 for detecting a rotation amount of the arm 12 as an accelerator opening degree. A hysteresis producing mechanism includes friction pieces 20 and 21 attached to the arm base part 12*a*. A curved contact surface 20*a* of the friction piece 20 is held in contact with a contacted surface 19*a* of a friction part 19 of the support case 13. One end of the return spring 16 and 17 is hooked in one end of the friction piece 20 and 21, and the other end of the spring 16 and 17 is connected to the arm base part 12*a* in order to press the contact surface 20*a* and 21*a* of the friction piece 20 and 21 against the contacted surface 19*a* of the friction part 19.

9 Claims, 13 Drawing Sheets

ACCELERATOR DEVICE

BACKGROUND OF THE INVENTION

1. Field of the Invention

The present invention relates to an accelerator device which is used in for example an electronic control throttle system of an engine for vehicle. More specifically, the present invention relates to an accelerator device adapted to apply hesteresis to the pedal effort between depression force and return force on an accelerator pedal in order to improve the feel of the accelerator pedal in operation.

2. Description of Related Art

Conventionally, there has been known an electronic control throttle system using no accelerator cable as one of systems or apparatuses mounted on an engine for vehicle and others. The electronic control throttle system of this type includes an accelerator device constructed to detect a depressed amount of an accelerator pedal as an accelerator opening degree by an accelerator sensor. A throttle opening degree of the electronic control throttle system is controlled based on the accelerator opening degree detected by the accelerator sensor.

With respect to the above type, there have already been proposed many accelerator devices adapted to produce hysteresis between depression force and return force on an accelerator pedal in order to improve the operational feel of the accelerator pedal. Under these circumstances, the applicant of the present invention proposed an accelerator device in Japanese patent unexamined publication No. 2002-79844. This accelerator device includes easy-to-mount parts used for providing hysteresis to the pedal effort (pedal force) on the accelerator pedal and can produce the pedal effort hysteresis by stable movements.

As shown in FIG. 14, this accelerator device is provided with an accelerator arm 61 including an accelerator pedal on a tip part thereof, a support case 63 internally holding a base part 61*a* of the accelerator arm 61 (an arm base part) while rotatably supporting the arm base part 61*a* through a support shaft 62, a return spring 64 urging the accelerator arm 61 to rotate in a returning direction, thereby returning the accelerator pedal to an initial position, and an accelerator sensor 65 for detecting the rotation amount of the accelerator arm 61 as an accelerator opening degree. In addition, a friction member 66 having a tip end surface 66*a* which is held in contact with an inner surface 63*a* of the support case 63 is attached to the arm base part 61*a*. This friction member 66 is rotatably supported to the arm base part 61*a* through a support pin 67. The return spring 64, constructed of a tension spring, is tensioned between a part of the friction member 66 close to its tip and a spring hook 63*b* of the support case 63 in order to press the tip end surface 66*a* of the friction member 66 against the inner surface 63*a* of the support case 63. With the above structure, the rotation of the accelerator arm 61 causes the tip end surface 66*a* of the friction member 66 to slide along the inner surface 63*a* of the support case 63. Thus, as shown in FIG. 15, predetermined hysteresis is produced between depression force and return force on the accelerator pedal.

In the accelerator device described in the above publication, however, a stick slip (a catch) would occur in some cases while the tip end surface 66*a* of the friction member 66 is caused to slide along the inner surface 63*a* of the support case 63, thus impairing a smooth feel of the accelerator pedal.

It is surmised that this stick slip is caused when the strain occurring during the sliding of the tip end surface 66*a* of the friction member 66 along the inner surface 63*a* of the support case 63 returns in an instant. FIG. 16 shows the friction member 66 modeled into a "cantilever beam". In this figure, the tip of the cantilever beam corresponds to a "friction part". The spring force F and the pedal effort P act in mutually perpendicular directions at the tip end of the cantilever beam. The strain δ in this tip end is expressed by the following modeling formula (1). It is conceivable that the stick slip of the friction member 66 can be reduced when the device is adapted to minimize the strain δ:

$$\delta=\beta\cdot P\cdot l^3/E\cdot M \tag{1}$$

wherein "β" is a predetermined coefficient, "l" is the length of the "beam", "E" is a longitudinal elastic coefficient, and "M" is the geometrical moment of inertia of the "beam", respectively.

SUMMARY OF THE INVENTION

The present invention has been made in view of the above circumstances and has an object to overcome the above problems and to provide an accelerator device adapted to produce pedal effort hysteresis by sliding contact of a friction member, thereby reducing strain in a friction area of the friction member to achieve a smooth feel of an accelerator pedal without causing a stick slip.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the purpose of the invention, there is provided an accelerator device including: an accelerator arm including a tip part, a base part, and an accelerator pedal at the tip part; a support case internally holding and supporting the base part of the accelerator arm so that the base part is rotatable about a support shaft, the accelerator arm being supported to be rotatable together with the accelerator pedal between an initial position and a full open position in association with the rotation of the base part; a return spring for urging the accelerator arm to rotate in a returning direction to return the accelerator pedal to the initial position; an accelerator sensor for detecting a rotation amount of the accelerator arm as an accelerator opening degree; a friction part provided in the support case and including a contacted surface; a friction piece including a first end, a second end, and a contact surface provided between the first and second ends, the friction piece being attached at the first end to the base part of the accelerator arm while holding the contact surface in contact with the contacted surface so that friction is caused therebetween, the return spring being connected to the second end of the friction piece to press the contact surface against the contacted surface; wherein the contacted surface of the friction part is formed in an arcuate shape about the support shaft, the contact surface of the friction piece is formed in an arcuate shape with a diameter equal to that of the contacted surface of the friction part, and the friction piece is disposed so that the contact surface circumscribes the contacted surface, and rotation of the accelerator arm causes the friction piece as well as the base part to rotate, thereby sliding the contact surface of the friction piece on the contacted surface of the friction part to produce pedal force hysteresis between a depressing side and a returning side of the accelerator pedal.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

[First Embodiment]

A detailed description of a preferred embodiment of an accelerator device embodying the present invention will now be given referring to the accompanying drawings.

Figure 1:
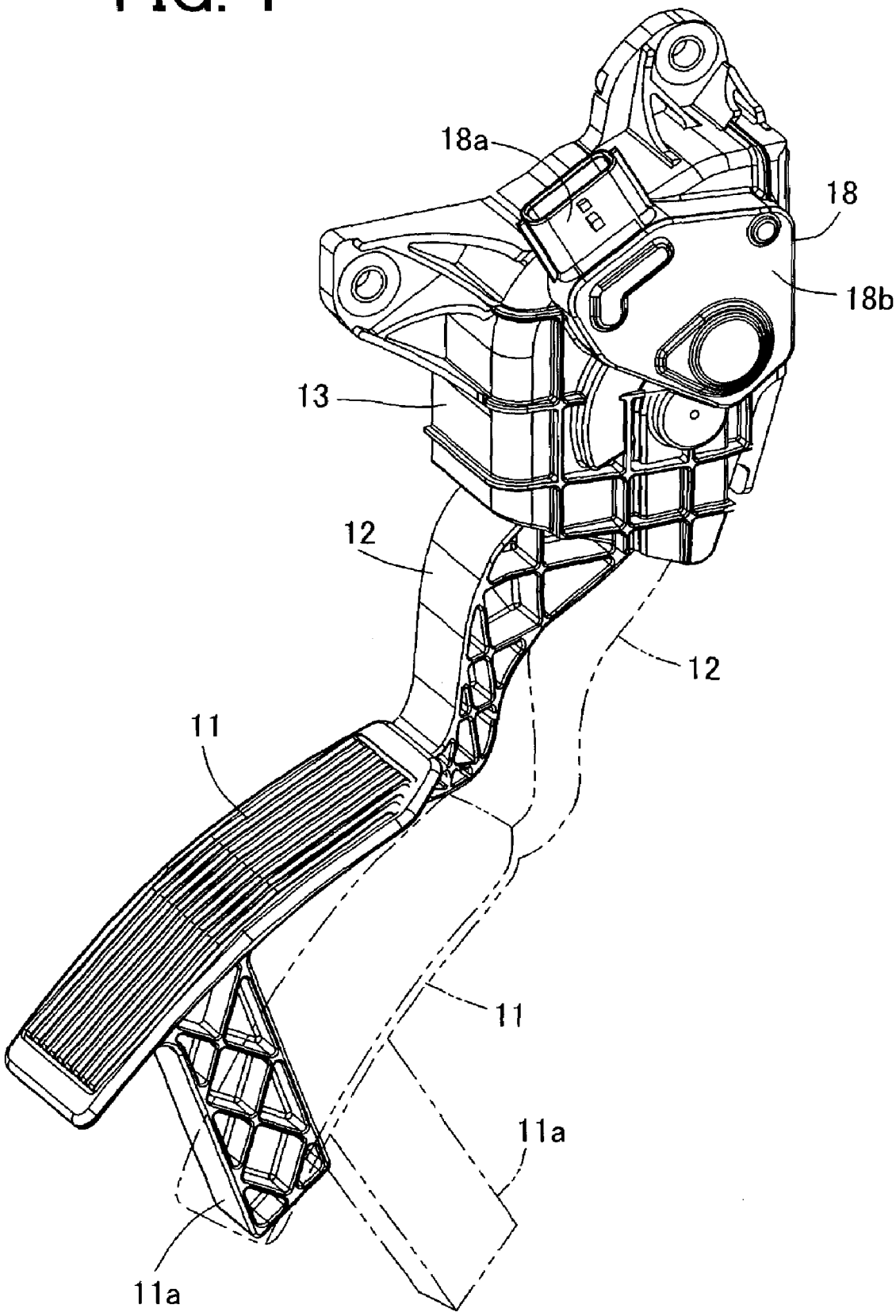
FIG. 1 is a perspective view of an accelerator device in a first embodiment.
Figure 2:
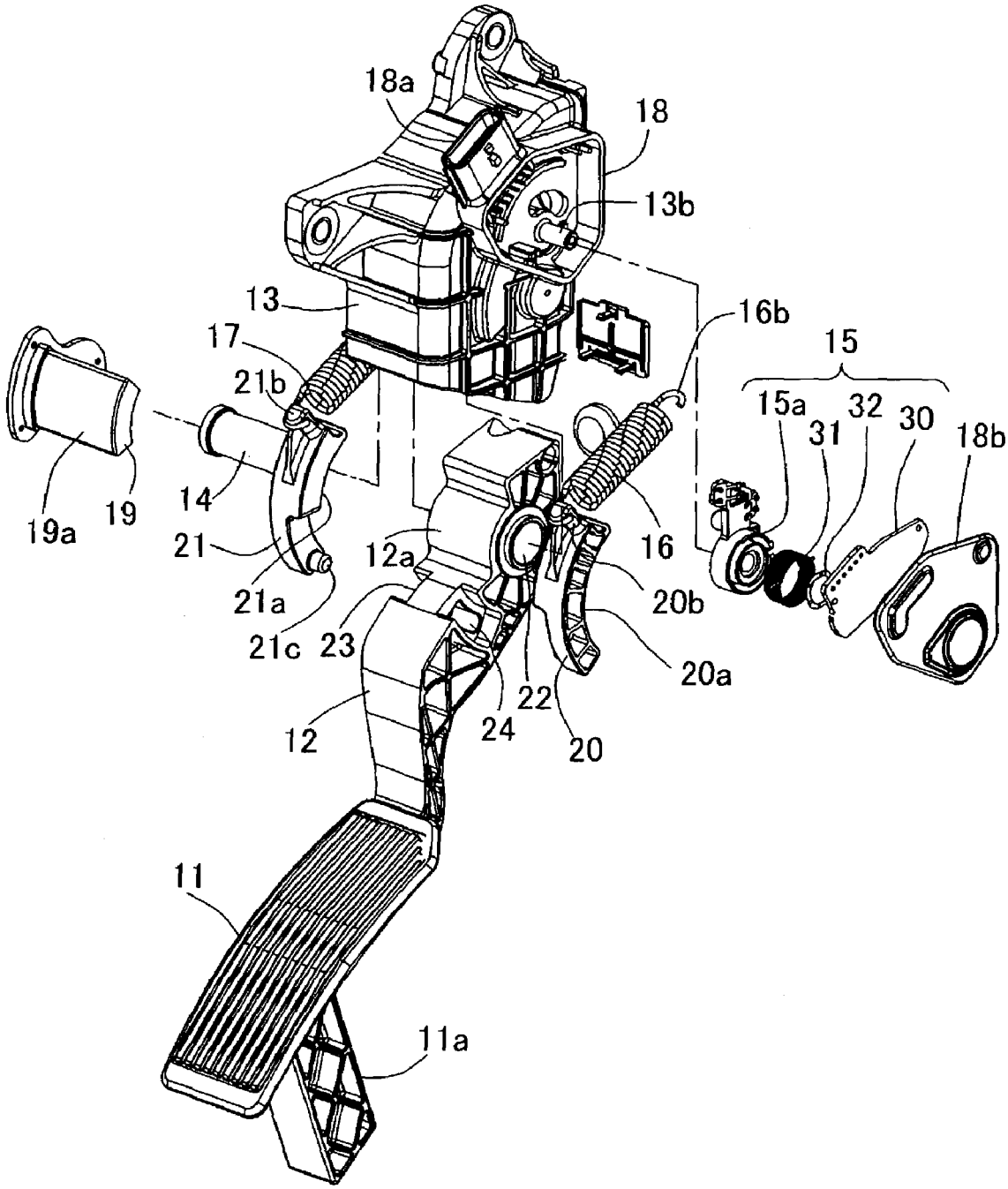
FIG. 2 is an exploded perspective view of the accelerator device.
Figure 3:
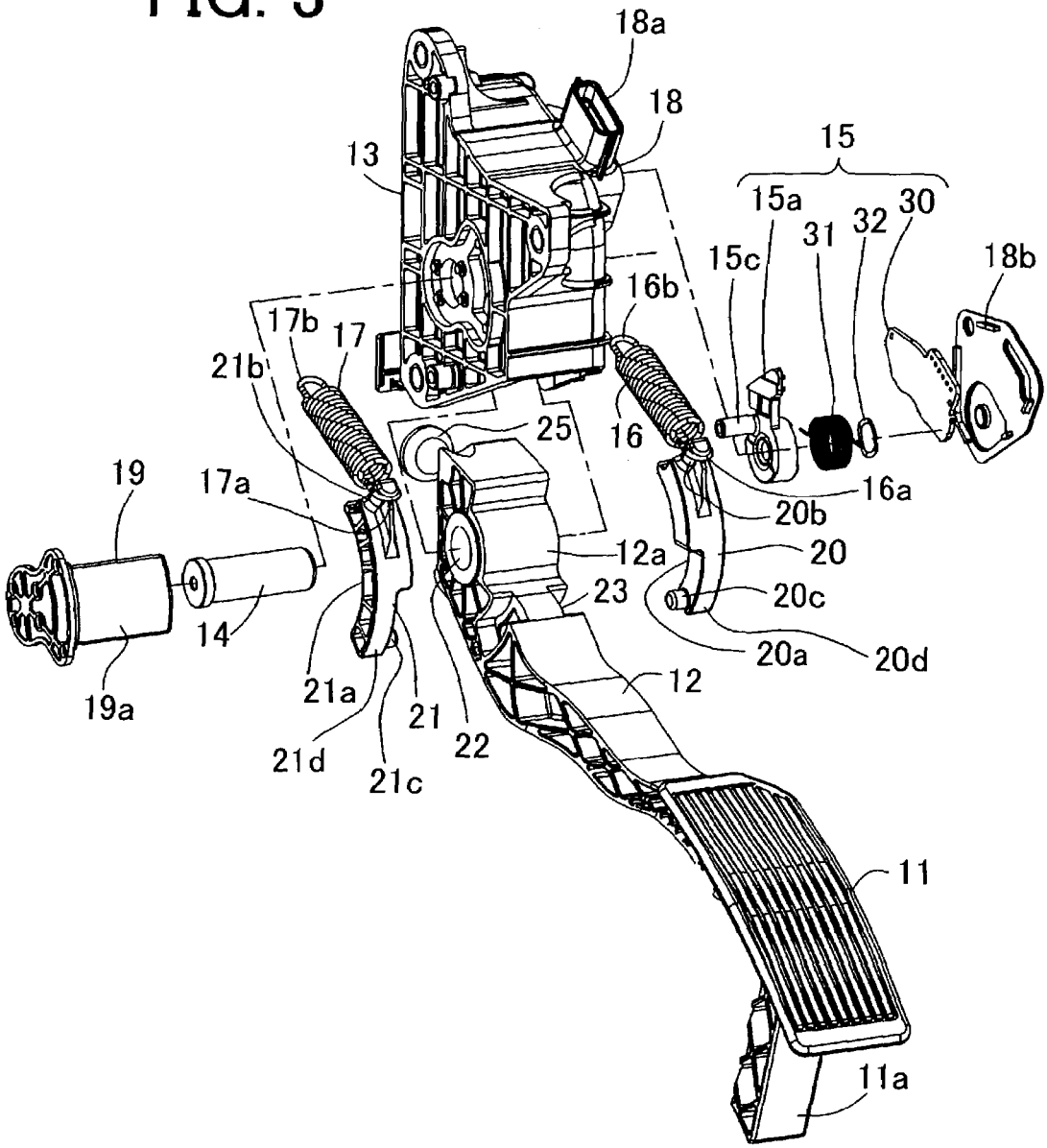
FIG. 3 is another exploded perspective view of the accelerator device.
Figure 4:
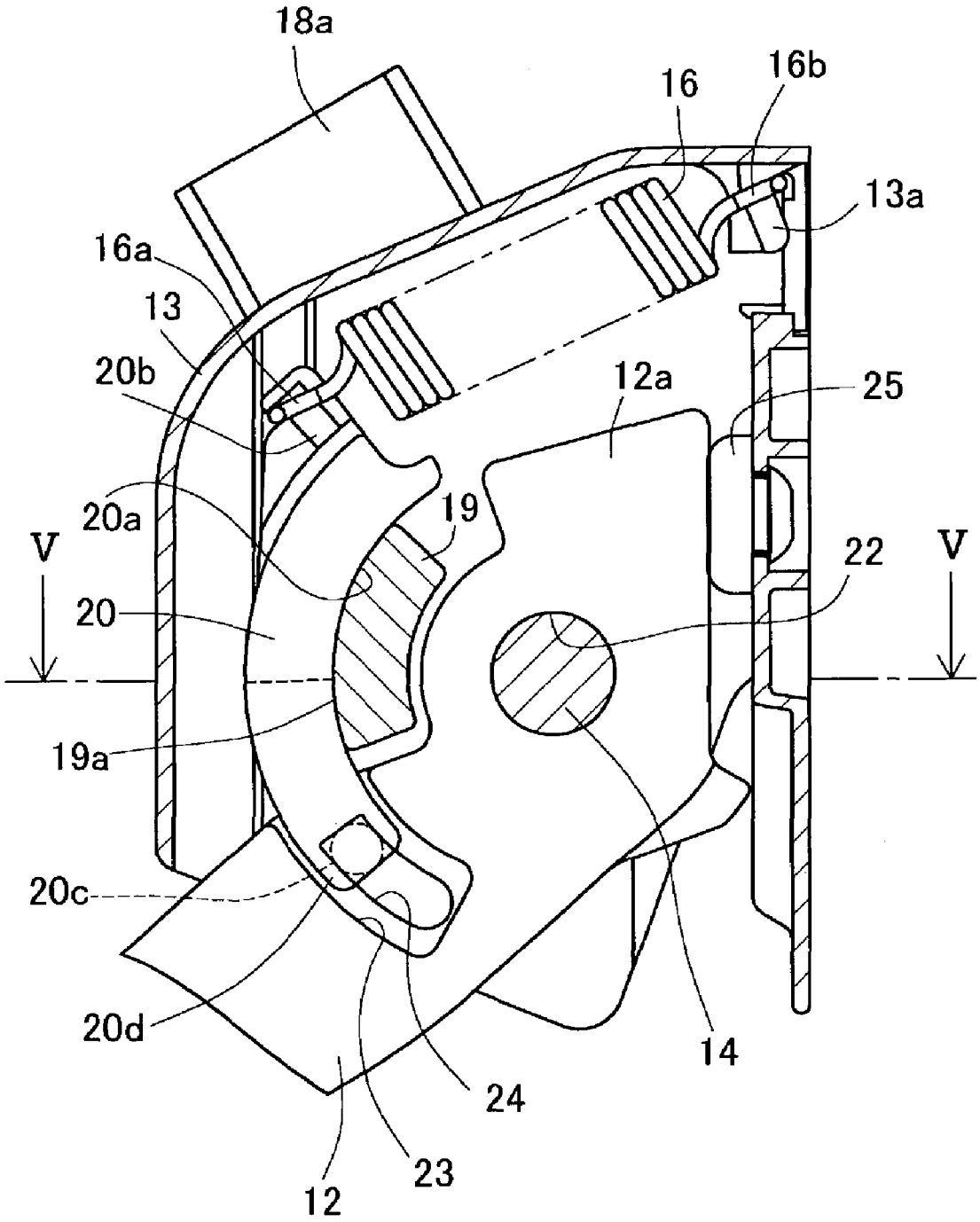
FIG. 4 is a longitudinal sectional view of a part of the accelerator device, showing an interior of a support case.
Figure 5:
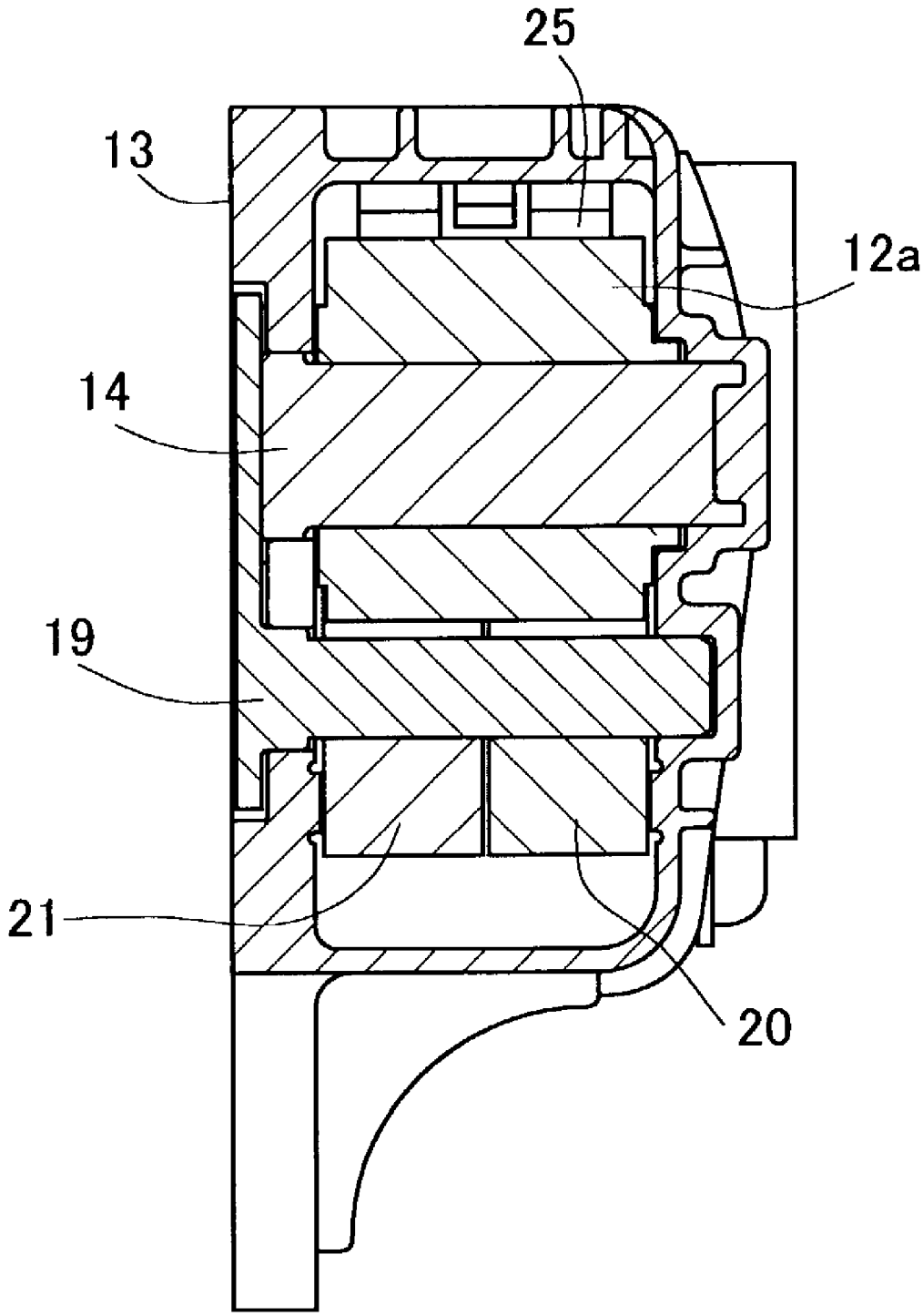
FIG. 5 is a sectional view taken along a line V—V in FIG. 4.
Figure 6:
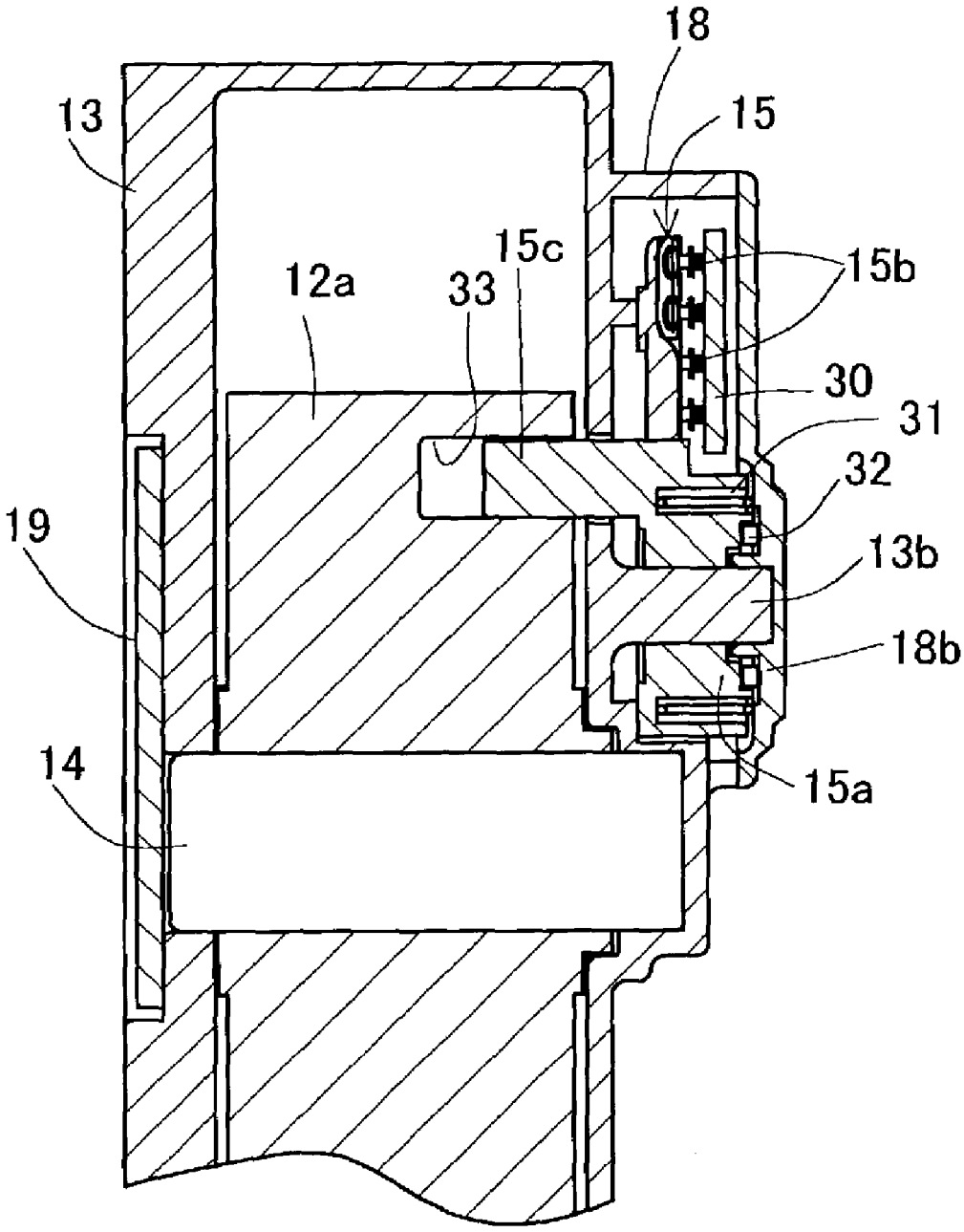
FIG. 6 is a cross sectional view of a part of the accelerator device, showing a sensor case of the support case.

FIG. 1 is a perspective view of an accelerator device in the first embodiment; FIGS. 2 and 3 are exploded perspective views of the accelerator device; and FIGS. 4, 5, and 6 are sectional views of main components of the accelerator device, showing different sections.

In the present embodiment, explanation is made on an accelerator device to be used in an electronic control throttle system of an engine for vehicle. This accelerator device has a basic structure including an accelerator arm 12 made of resin with an accelerator pedal 11 on the tip part, a support case 13 made of resin, a support shaft 14 made of metal, an accelerator sensor 15, and a pair of return springs 16 and 17 constructed of metal coils.

The accelerator pedal 11 is integrally provided on the tip part of the accelerator arm 12. A stopper 11*a* is integrally formed with the accelerator pedal 11 so as to extend downward from the underside of the accelerator pedal 11. The stopper 11*a* bumps against the floor of the vehicle when a driver fully depresses the accelerator pedal 11, so that the driver bodily feels an accelerator full open state. The support case 13 internally holds a base part 12*a* (hereinafter, referred to as an "arm base part") of the accelerator arm 12 and rotatably supports the arm base part 12*a* through the support shaft 14. By the rotation of the arm base part 12*a*, the accelerator arm 12 is allowed to rotate together with the accelerator pedal 11 between an initial position shown by a solid line in FIG. 1 and a full open position shown by a chain double-dashed line in FIG. 1. The pair of return springs 16 and 17 serve to urge the accelerator arm 12 to rotate in a returning direction in order to return the arm 12 to the initial position. These two return springs 16 and 17 can operate individually as a fail safe in case one of them fails to work. The accelerator sensor 15 serves to detect the rotation amount of the accelerator arm 12 as an accelerator opening degree. This sensor 15 is housed in a sensor case 18 integrally formed with the support case 13. The sensor case 18 is also integrally provided, on its upper side, with a socket 18*a*.

The support case 13 is provided with a friction member 19 as a friction part of the present invention, including a contacted surface 19*a*. This friction member 19 serves to produce hysteresis between depression force and return force on the accelerator pedal 11, thereby improving the operational feel of the accelerator pedal 11. On the arm base part 12*a*, a pair of friction pieces 20 and 21 are disposed. These friction pieces 20 and 21 include contact surfaces 20*a* and 21*a*, respectively, which are held in contact with the contacted surface 19*a*. In the present embodiment, the friction pieces 20 and 21 each have a substantially circularly arcuate shape. The contact surface 20*a* is provided on the internal diameter side of the arcuate friction piece 20, defined between one end and the other end in a circumferential direction. The friction piece 21 has identical but symmetrical structure to the friction piece 20. For causing friction, the contact surfaces 20*a* and 21*a* are positioned in contact with the contacted surface 19*a* of the friction member 19 and each one end (lower end in FIG. 4, corresponding to a first end in the invention) of the friction pieces 20 and 21 is connected with the arm base part 12*a*. In order to press the contact surfaces 20*a* and 21*a* of the friction pieces 20 and 21 against the contacted surface 19*a* of the friction member 19, one ends 16*a* and 17*a* of the return springs 16 and 17 are engaged with hooks 20*b* and 21*b* formed at the other ends (upper ends in FIG. 4, corresponding to a second end in the invention) of the friction pieces 20 and 21. The other ends 16*b* and 17*b* of the return springs 16 and 17 are engaged with hooks 13*a* formed in the support case 13. The friction member 19 in the present embodiment is formed separately from and mounted in the support case 13. Of the friction member 19 and the friction pieces 20 and 21, one is made of glass-fiber reinforced resin (PA46) and the other(s) is made of POM (polyoxymethylene). In the present embodiment, for example, the friction member 19 is made of glass-fiber reinforced resin (PA46) and the friction pieces 20 and 21 are made of POM (polyoxymethylene). This combination of such materials can provide a good sliding property and excellent abrasion resistance.

In the present embodiment, it is effective that the amount of the glass-fiber reinforced resin (PA46) is 10% or more by weight, more preferably 20% to 40% by weight. The POM may be used alone or blended with PTFE (polytetrafluoroethylene), olefin, oil, or calcium carbonate, etc. Such material composition can enhance the sliding property between the friction member and the friction pieces and further improve the abrasion resistance.

As shown in FIG. 4, a shaft hole 22 is formed at a center of the arm base part 12*a*. The support shaft 14 is fit in this shaft hole 22. The paired friction pieces 20 and 21 are disposed one by one in correspondence with both side surfaces (i.e., right and left sides) of the arm base part 12*a* in its width direction (in a right and left direction in FIGS. 2 and 3). In each side surface of the arm base part 12*a*, a recess 23 is formed in an arcuate shape about the support shaft 14. Each recess 23 is provided therein with a slot 24 formed penetrating the arm base part 12*a* and having an arcuate shape about the support shaft 14. The friction pieces 20 and 21 are attached to the arm base part 12*a* with one ends 20*d* and 21*d* being received in the corresponding recesses 23 respectively and simultaneously pins 20*c* and 21*c* being engaged in the corresponding slots 24 respectively. In the present embodiment, the contacted surface 19*a* is formed in the friction member 19 so as to be arcuate about the support shaft 14. In addition, the contact surfaces 20*a* and 21*a* of the friction pieces 20 and 21 are designed to have an arcuate shape with a diameter equal to that of the contacted surface 19*a* so that the contact surfaces 20*a* and 21*a* circumscribe the contacted surface 19*a*. In association with the rotation of the accelerator arm 12, the friction pieces 20 and 21 are moved together with the arm base part 12*a*, thereby causing the contact surfaces 20*a* and 21*a* to slide on the contacted surface 19*a* of the friction member 19. This structure produces hysteresis to the force on the accelerator pedal 11 between the time of depressing and the time of returning the accelerator pedal 11. The support case 13 is internally provided with a stopper 25. When the accelerator pedal 11 is returned to the initial position, the back of the arm base part 12*a* comes into contact with the stopper 25, thereby restricting the excessive movement of the accelerator pedal 11 in the returning direction.

As shown in FIG. 6, the accelerator sensor 15 includes a sensor lever 15*a*, a plurality of brushes 15*b* attached to the lever 15*a*, and a base plate 30 facing the brushes 15*b*. The sensor lever 15*a* is formed with a center hole in which a protruding pin 13*b* formed in the support case 13 is inserted. This sensor lever 15*a* is further held in the sensor case 18 through a coil spring 31 and a wave ring 32. The sensor case 18 is tightly closed with a cap 18. The sensor lever 15*a* is rotatable about a pin 15*c*. This pin 15*c* formed in a protruding shape in the sensor lever 15*a* is engaged in a hole 33 formed in a side surface of the arm base part 12*a* and therefore is fixed to the arm base part 12*a*. Accordingly, the rotation of the hole 33 together with the arm base part 12*a* causes the sensor lever 15*a* to rotate about the pin 15*c*, moving the brushes 15*b* on the base plate 30. Based on the moved range of the brushes 15*b* corresponding to the rotation amount of the sensor lever 15*a*, the accelerator sensor 15 detects the accelerator opening degree.

In the above described accelerator device in the present embodiment, the accelerator arm 12 is configured so that the base part 12*a* is rotated about the support shaft 14 with respect to the support case 13, as shown by the solid line and the double-dashed line in FIG. 1, in response to the depression or return of the accelerator pedal 11. At this time, in association with the rotation of the base part 12*a*, the contact surfaces 20*a* and 21*a* constituting the inner sides of the friction pieces 20 and 21 respectively are caused to slid along the contacted surface 19*a* of the friction member 19, thereby providing hysteresis to the pedal effort between the time of depressing and the time of returning the accelerator pedal 11. In other words, at the time of depressing the accelerator pedal 11, the pedal effort resultant of the urging force of the return springs 16 and 17 and the sliding resistance between the friction pieces 20 and 21 and the friction member 19 is exerted on the foot of the driver. On the other hand, at the time of returning the accelerator pedal 11, the pedal effort resultant of the urging force of the return springs 16 and 17 from which the sliding resistance is subtracted is exerted on the foot of the driver. Thus, hysteresis is produced between the depression force and the return force on the accelerator pedal 11.

Figure 7:
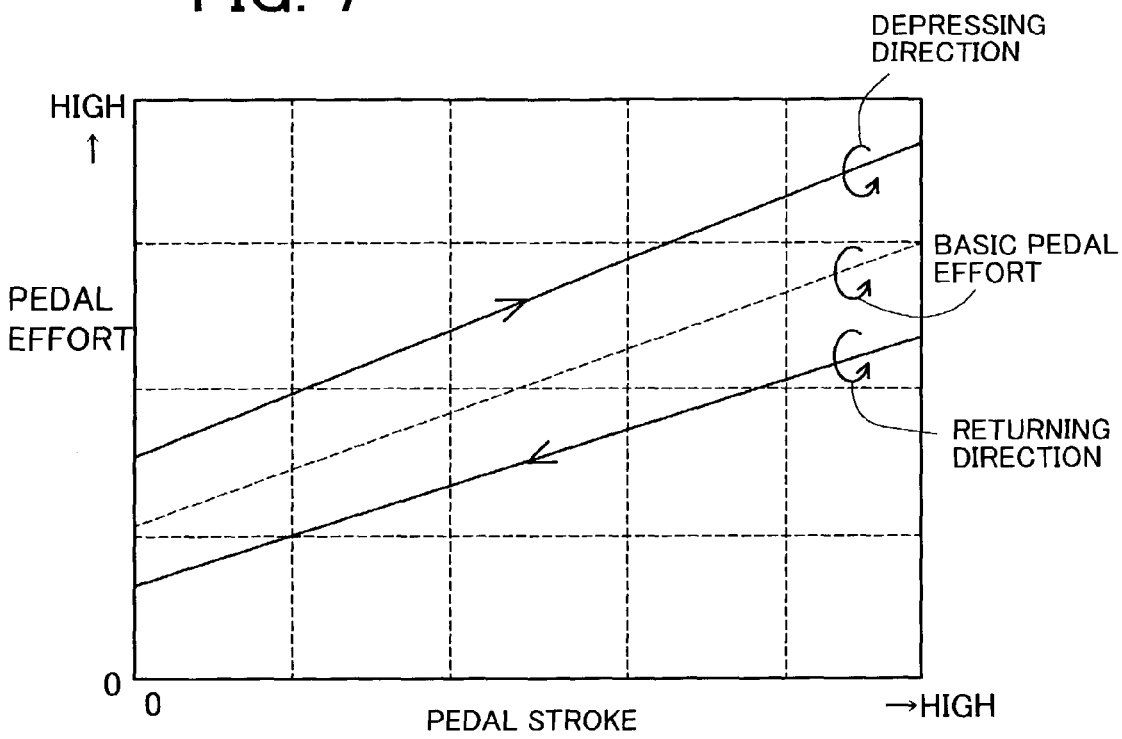
FIG. 7 is a graph showing a relation between pedal effort and pedal stroke.

FIG. 7 is graph showing a relation in characteristics between the pedal effort and the stroke of the accelerator pedal (pedal stroke). As can be seen from this graph, there were remarkable differences in pedal effort between a depressing direction and a returning direction. Furthermore, it was found that the pedal effort in the depressing direction was larger than the basic pedal effort, while the pedal effort in the returning direction was smaller than the basic pedal effort. It was also determined that the relationship between the pedal stroke and the pedal effort has linearity.

According to the accelerator device in the present embodiment, if only the member constituting the friction member 19 and the friction pieces 20 and 21 are simply added to the basic structure including the accelerator pedal 11, the accelerator arm 12, the support case 13, and the return springs 16 and 17, and others, the pedal effort on the accelerator pedal 11 can include hysteresis. Accordingly, the friction pieces 20 and 21 for producing the pedal effort hysteresis can easily be combined to the basic structure. Moreover, the contact surfaces 20*a* and 21*a* forming the inner sides of the friction pieces 20 and 21 are constantly pressed against the contacted surface 19*a* of the friction member 19 mounted in the support case 13 by the steady urging force of the return springs 16 and 17. This makes it possible to produce the pedal effort hysteresis under constantly stable operations. In particular, in the present embodiment, the contact surfaces 20*a* and 21*a* each provided extending between one end and the other end of each friction piece 20, 21 are pressed against the contacted surface 19*a* of the friction member 19, so that the force of the return springs and the pedal effort on the accelerator pedal 11 act along the contacted surface 19*a*, thereby reducing the strain in the friction pieces 20 and 21.

More specifically, the accelerator device in the present embodiment has no trouble with the stick slip that would occur in the prior art accelerator device when the tip end surface 66*a* of the friction piece 66 is slid on the inner surface 63*a* of the support case 63. Thus, the strain in the friction region in the friction pieces 20 and 21 can be reduced, achieving a smooth accelerator operational feel without stick slips. This is because the occurrence of the strain in the friction pieces 20 and 21 can be prevented as mentioned above and can be explained is as follows.

Figure 8:
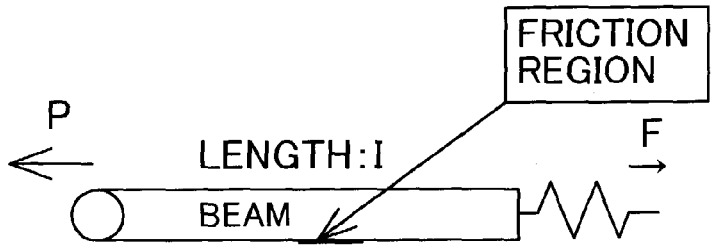
FIG. 8 is a modeling view showing a relation between a friction region and pedal effort P and spring force F.

FIG. 8 is a modeling view showing a relation between the friction region and the pedal effort P and the spring force F. In this modeling view, the friction pieces 20 and 21 are substituted by a "beam", wherein the longitudinal side surface of the beam corresponds to the "friction region" and the spring force F and the pedal effort P act in parallel on the side surface. The strain in this side surface is expressed by the modeling formula (2):

$$\delta = P \cdot I / A \cdot E \tag{2}$$

wherein "I" is the length of the "beam", "E" is a longitudinal elastic coefficient, and "A" is a cross sectional area of the beam, respectively. According to this modeling formula (2), as is shown by comparing with the above mentioned modeling formula (1) in the prior art, the degree of the numerator "I" of the fraction is lower than that in the prior art, which results in a reduction in the strain δ as compared with that in the prior art. Since the strain δ can be minimized as above, the stick slip can be reduced with respect to the friction pieces 20 and 21.

Figure 9:
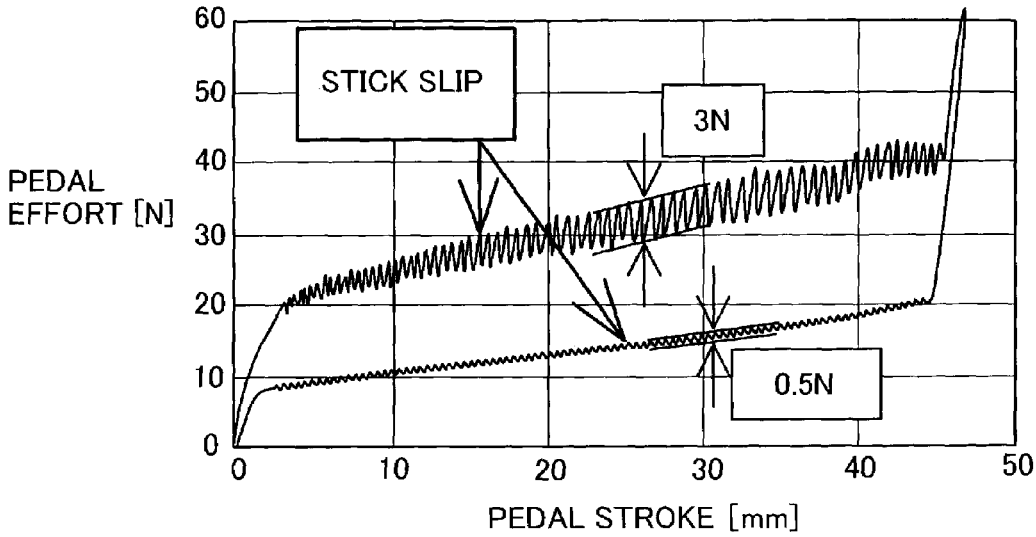
FIG. 9 PRIOR ART
FIG. 9 is a graph showing a relation between pedal effort and pedal stroke in a prior art.
Figure 10:
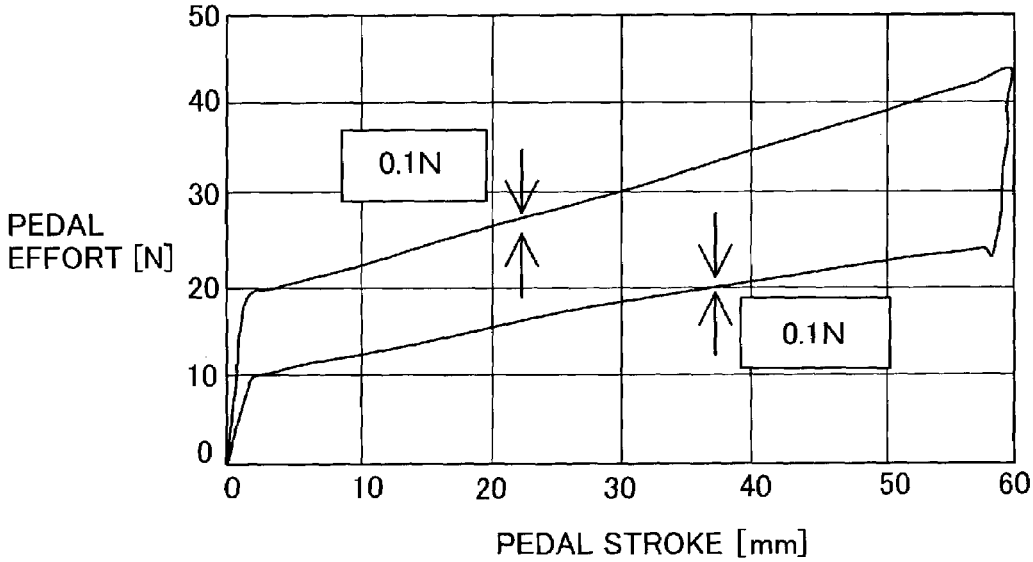
FIG. 10 is a graph showing a relation between pedal effort and pedal stroke in the present embodiment.

FIG. 9 is a graph showing the relation between the pedal effort and the pedal stroke in the prior art accelerator device. FIG. 10 is a graph showing the relation between the pedal effort and the pedal stroke in the accelerator device in the present embodiment. As can be seen from the graph of FIG. 9 related to the prior art, the pedal effort lines in the depressing direction (upper line) and the returning direction (lower line) include amplitudes indicating the existence of stick slips. It is apparent from this graph that the amplitudes of stick slips in the depressing direction are particularly distinguished, "3N". On the other hand, in the graph of FIG. 10 related to the present embodiment, the amplitudes in both the depressing direction (upper line) and the returning direction (lower line) are small, "0.1N", which is obviously smaller than the amplitudes in the prior art, "3N" and "0.5N".

In the present embodiment, if one of the two friction pieces 20 and 21 is broken or damaged, the other one is operated in cooperation with the corresponding one of the return springs 16 and 17, thereby ensuring the pedal effort hysteresis. Even if the broken one of the friction pieces 20 and 21 is fixed to the arm base part 12*a*, movement (rotation) of the other normal one is permitted by the slot 24 formed in the recess 23. Accordingly, the accelerator arm 12 can be returned to the original position by the urging force of the return springs 16 and 17. After the friction piece 20 or 21 is broken, the urging force of the return springs 16 and 17 can act on the accelerator arm 12 and therefore the basic operations of the accelerator device can be ensured. In other words, the accelerator pedal 11 can be returned from the depressed state even after the breakage of the friction piece 20 or 21 is caused, so that the electronic control throttle system can continuously be operated by the driver.

According to the accelerator device in the present embodiment, of the friction pieces 20 and 21 and the friction member 19, one is made of glass-fiber reinforced resin (PA46) and the other is made of POM (polyoxymethylene). Thus, the combination of materials of the friction pieces 20 and 21 and the friction member 19 can be optimized, so that changes in the coefficient of friction between the friction pieces 20 and 21 and the friction member 19 after an endurance test are reduced. Accordingly, even after the endurance test of the accelerator device, the characteristic changes in the pedal effort hysteresis can be decreased and the life of the accelerator device can be improved.

Figure 11:
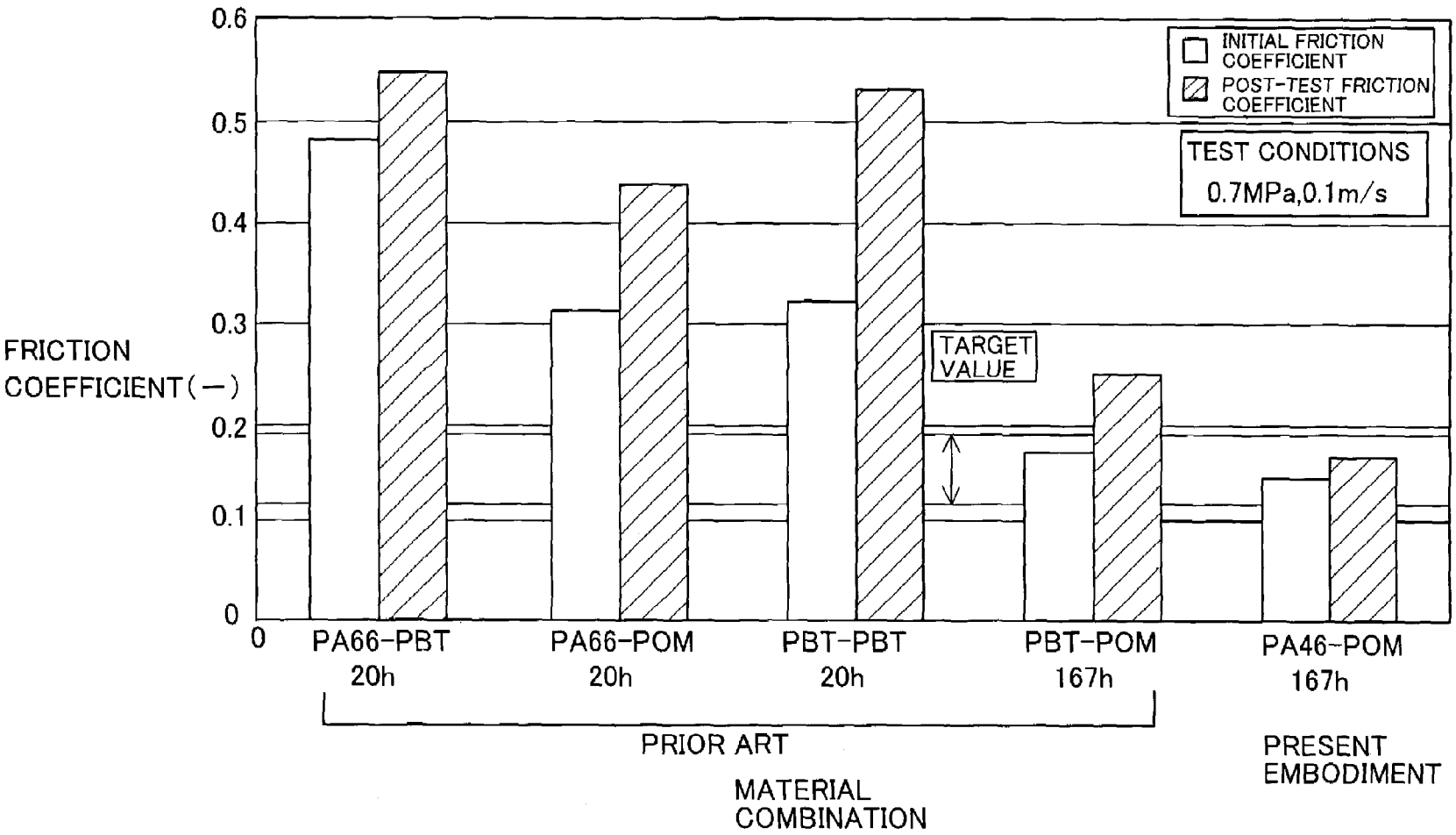
FIG. 11 is a graph showing a relation between a combination of primary materials and a coefficient of friction.

Here are changes in the coefficient of friction between the friction pieces and the friction member made of the above materials; PA46 and POM, respectively, before and after the endurance test in comparison with changes in the coefficient of friction between the friction pieces and the friction member made of different materials from above. In this test, the comparative materials were "a combination of PA66 and PBT (polybutylene terephthalate)", "a combination of PA66 and POM", "a combination of PBT and PBT", and "a combination of PBT and POM". The test conditions were that the friction pieces were operated to continuously slide with respect to the friction member at a speed of "0.1 m/s" by the force of "0.7 MPa". FIG. 11 is a graph showing each data on an "initial friction coefficient" and a "post-test friction coefficient" by comparison. As can be seen from this graph, the material (PA46-POM) used in the present embodiment resulted in that both the "initial friction coefficient" and the "post-test friction coefficient" were within a desired range of 0.1 to 0.2 even after the endurance test of 167 hours. On the other hand, other comparative materials (PA66-PBT, PA66-POM, PBT-PBT) resulted in that both the "initial friction coefficient" and the "post-test friction coefficient" largely exceeded the desired range after a lapse of 20 hours of the endurance time. The best comparative material (PBT-POM) also resulted in that the "post-test friction coefficient" exceeded the desired range after a lapse of 167 hours.

According to the accelerator device in the present embodiment, a part of each friction piece 20, 21 is engaged in the recess 23, which prevents each friction piece 20, 21 from largely protruding from the arm base part 12*a*. Accordingly, the friction pieces 20 and 21 serving to produce the pedal effort hyesteresis can be mounted compactly in the basic structure of the device. This makes it possible to downsize the entire accelerator device. Furthermore, in case the friction pieces 20 and 21 are broken or damaged, the friction pieces 20 and 21 are received in the recesses 23 respectively. Even after breakage of the friction pieces 20 and 21, the urging force of the return springs 16 and 17 can act on the accelerator arm 12, thus ensuring the basic operation of the accelerator device. Consequently, the accelerator pedal 11 can be prevented from being fixed in a depressed state due to the breakage of the friction pieces 20 and 21. This makes it possible for the driver to continuously operate the electronic control throttle system.

[Second Embodiment]

Next, a second embodiment of the accelerator device according to the present invention will be explained, referring to the accompanying drawing. It is to be noted that, in the subsequent embodiments mentioned below, components or parts identical to those in the first embodiment are indicated by the same reference numerals and explanations thereof are omitted. The following embodiments are explained with a focus on different features from the first embodiment.

Figure 12:
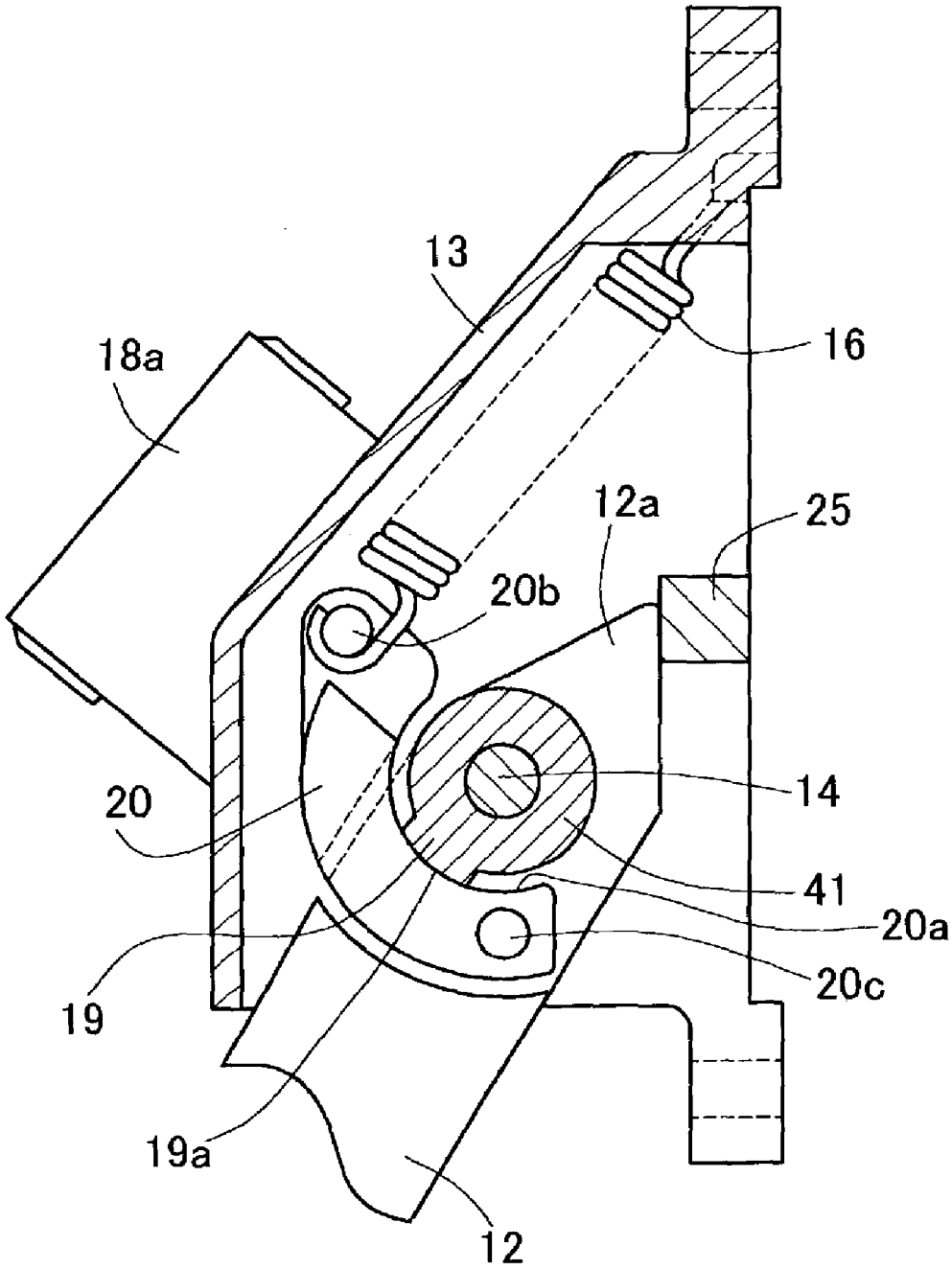
FIG. 12 is a longitudinal sectional view of a part of an accelerator device in a second embodiment, showing an interior of a support case.

FIG. 12 is a sectional view of a main part of the accelerator device in the second embodiment, this view being modeled after FIG. 4. In the second embodiment, a boss 41 is integrally formed in a support case 13 to support a shaft 14. This boss 41 is formed with a protrusion extending from a part of the circumference, which is used for a friction member 19. This friction member 19 has a tip end surface constituting a contacted surface 19*a* which is held in contact with a contact surface 20*a*. In these respects, the accelerator device in the present embodiment differs from that in the first embodiment.

Consequently, the accelerator device in the present embodiment can provide similar effects and advantages to those in the first embodiment. In addition, in the present embodiment, the friction member 19 being formed integral with the support case 13, the number of parts constituting the device can be reduced as compared with the case where the friction member 19 is separately formed from the support case 13.

[Third Embodiment]

Next, a third embodiment of the accelerator device according to the present invention will be explained, referring to the accompanying drawing.

Figure 13:
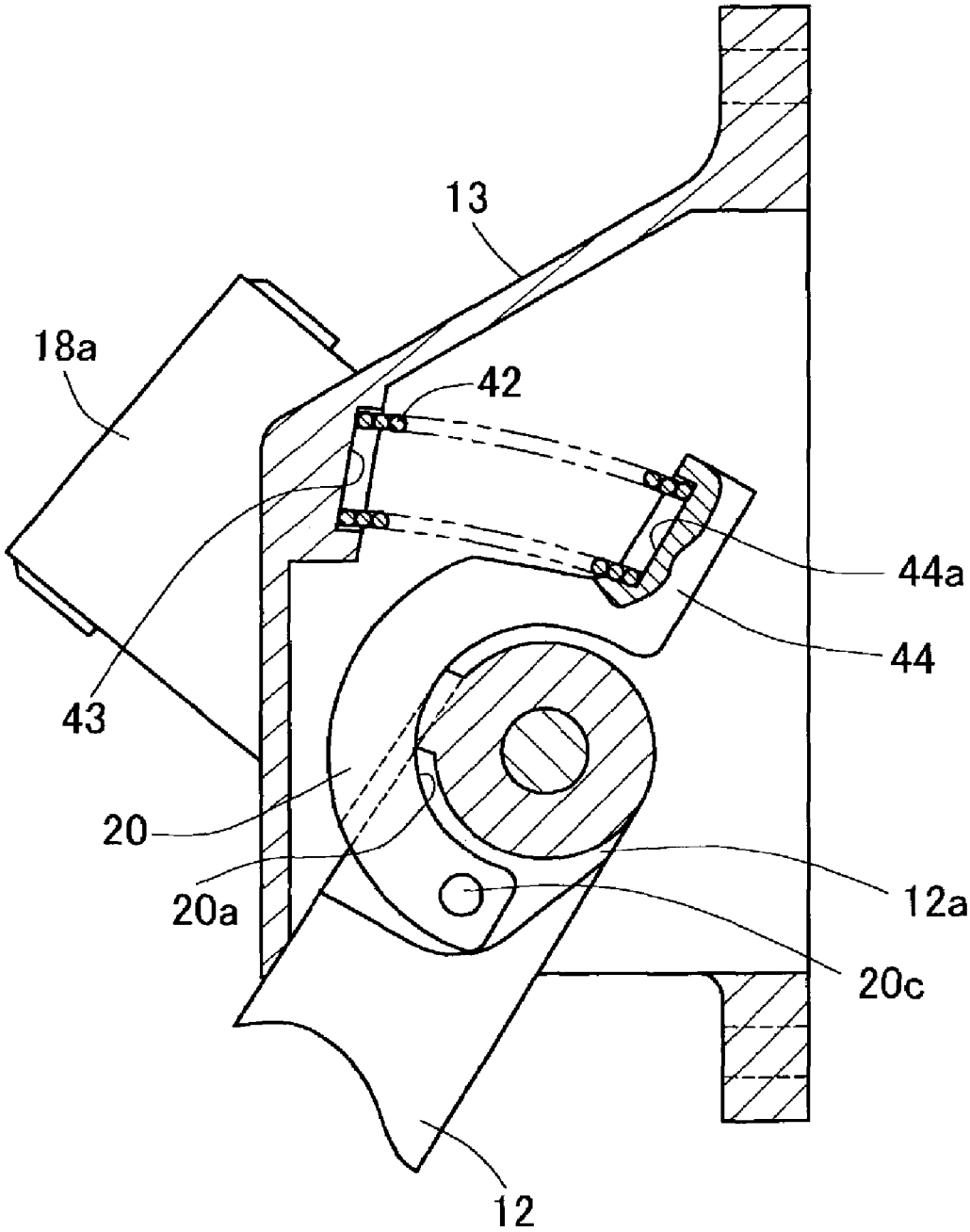
FIG. 13 is a longitudinal sectional view of a part of an accelerator device in a third embodiment, showing an interior of a support case.
Figure 14:
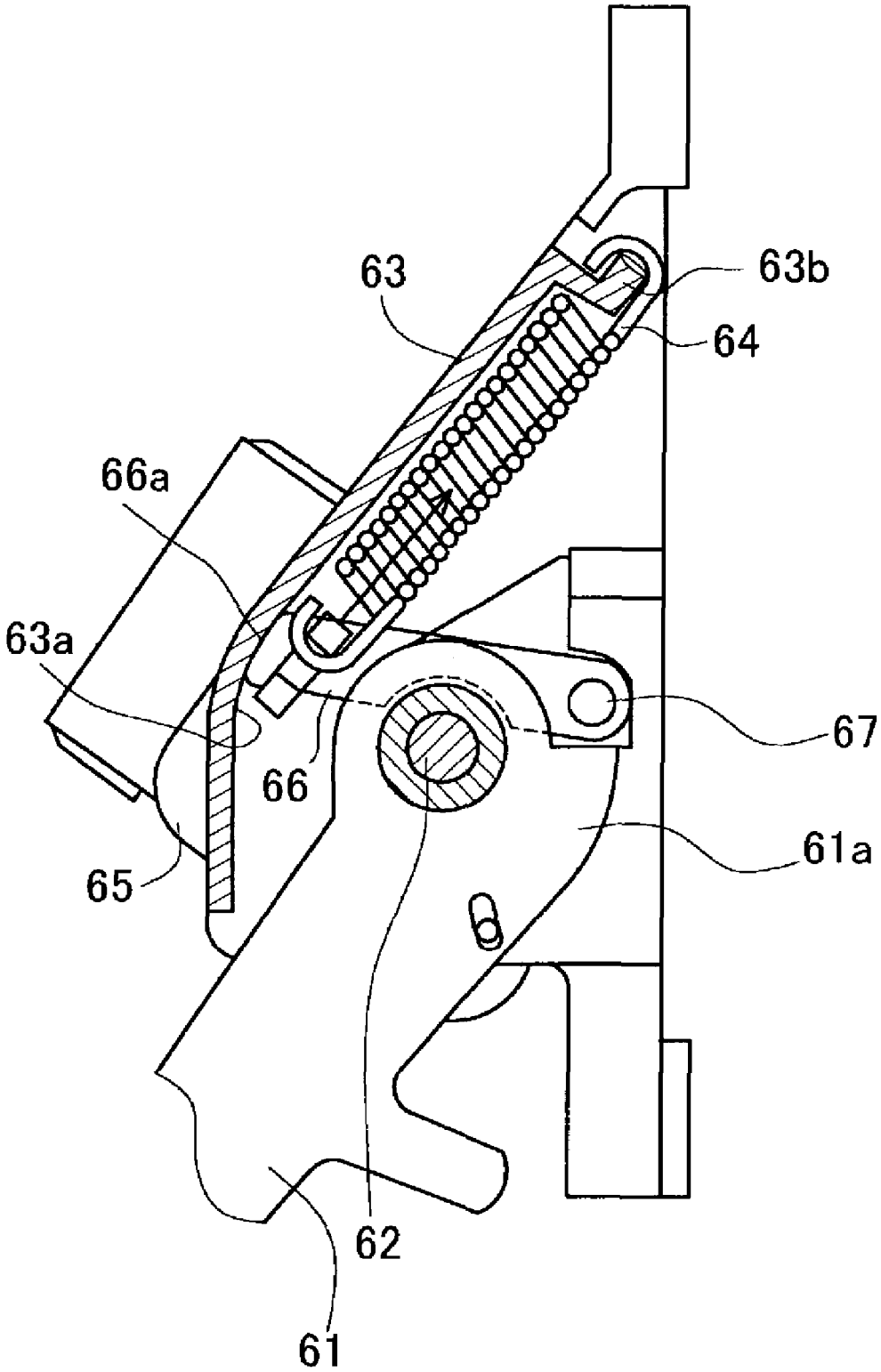
FIG. 14 PRIOR ART
FIG. 14 is a longitudinal sectional view of a part of an accelerator device in the prior art.
Figure 15:
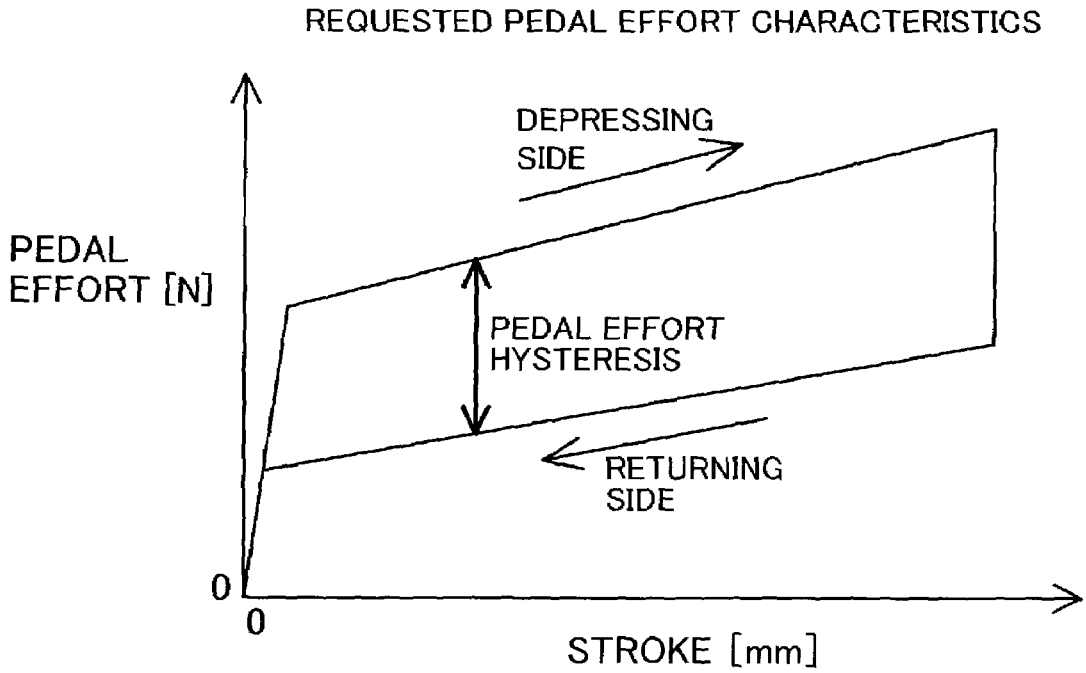
FIG. 15 PRIOR ART
FIG. 15 is a graph showing a relation between pedal effort and pedal stroke in the prior art.
Figure 16:
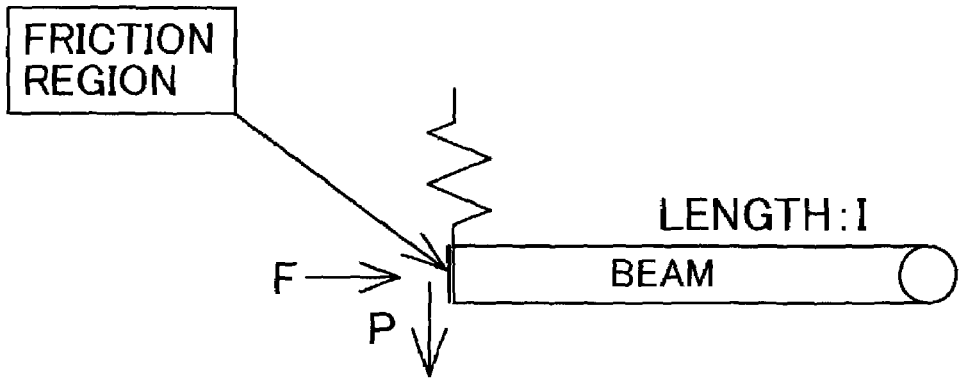
FIG. 16 PRIOR ART
FIG. 16 is a modeling view showing a relation between a friction region and pedal effort P and spring force F in the prior art.

FIG. 13 is a sectional view of a main part of the accelerator device in the third embodiment, this view being modeled after FIG. 12. The present embodiment differs from the second embodiment in that a return spring 42 constructed of a compression spring is used in stead of the return spring 16 constructed of a tension spring. In the present embodiment, for adoption of the compression return spring 42, a recess 43 for receiving one end of the spring 42 is formed in the inner surface of a support case 13. One end of a friction piece 20 is integrally formed with an arm part 44 with a recess 44*a* for receiving the other end of the spring 42.

Consequently, this accelerator device in the present embodiment can provide similar effects and advantages to those in the second embodiment.

The present invention may be embodied in other specific forms without departing from the spirit or essential characteristics thereof.

For instance, the device in the first embodiment is configured so that the friction pieces 20 and 21 are partially engaged in the recesses 23 of the arm base part 12*a*, but those recesses may be eliminated. In this case, the friction pieces are arranged next to the side surfaces of the arm base part and the contact surfaces of the friction pieces are positioned in contact with the contacted surface of the friction member.

In the first embodiment, there are provided the paired friction pieces 20 and 21 and the pair of return springs 16 and 17 individually corresponding to the friction pieces 20 and 21. An alternative design is to use a single friction piece and a single return spring.

In the above embodiments, almost all the parts constituting the accelerator device are made of resin. Alternatively, parts made of resin and parts made of metal may be combined to constitute the accelerator device. In this case, however, at least the friction pieces and the friction member corresponding thereto are preferably made of resin to achieve adequate sliding resistance.

While the presently preferred embodiment of the present invention has been shown and described, it is to be understood that this disclosure is for the purpose of illustration and that various changes and modifications may be made without departing from the scope of the invention as set forth in the appended claims.

What is claimed is:

1. An accelerator device, including:

an accelerator arm including a tip part, a base part, and an accelerator pedal at the tip part;

a support case internally holding and supporting the base part of the accelerator arm so that the base part is rotatable about a support shaft, the accelerator arm being supported to be rotatable together with the accelerator pedal between an initial position and a full open position in association with the rotation of the base part;

a return spring for urging the accelerator arm to rotate in a returning direction to return the accelerator pedal to the initial position;

an accelerator sensor for detecting a rotation amount of the accelerator arm as accelerator opening degree;

a friction part provided in the support case and including a contacted surface; and a friction piece including a first end, a second end, and a contact surface provided between the first and second ends, the friction piece being attached at the first end to the base part of the accelerator arm while holding the contact surface in contact with the contacted surface so that friction is caused therebetween, the return spring being connected to the second end of the friction piece to press the contact surface against the contacted surface, wherein the contacted surface of the friction part is formed in an arcuate shape about the support shaft, the contact surface of the friction piece is formed in an arcuate shape with a diameter equal to that of the contacted surface of the friction part, and the friction piece is disposed so that the contact surface circumscribes the contacted surface, rotation of the accelerator arm causes the friction piece as well as the base part to rotate, thereby sliding the contact surface of the friction piece on the contacted surface of the friction part to produce pedal force hysteresis between a depressing side and a returning side of the accelerator pedal, the friction piece is provided in pairs on both side surfaces of the base part of the accelerator arm in its width direction, a slot is formed in each side surface of the base part, the slot being of an arcuate shape about the support shaft, each first end of the friction pieces is movably engaged in a corresponding one of the slots through a pin, the return spring is provided in pairs in correspondence with the friction pieces, and each second end of the friction pieces is connected to a corresponding one of the return springs.

2. The accelerator device according to claim 1, wherein a recess is formed in each side surface of the base part of the accelerator arm, the recess being of an arcuate shape about the support shaft, each slot is formed in each recess, and the friction pieces are attached to the base part of the accelerator arm by the pins inserted in the slots while the first ends are received in the recesses respectively.

3. The accelerator device according to claim 1, wherein the friction part is separately formed from the support case and is mounted in the support case.

4. The accelerator device according to claim 1, wherein the support case is integrally provided with a boss for supporting the support shaft, and the boss is formed with a protrusion extending from a part of the circumference of the boss, the protrusion being used for the friction part and including a tip end surface used for a contacted surface which is held in contact with contact surface of the friction piece.

5. The accelerator device according to claim 1, wherein the return spring is a tension spring, a hook for connecting the return spring to the support case is formed in the support case, the friction piece is formed at the second end thereof with a hook, and one end of the return spring is connected to the hook of the friction piece and the other end of the return spring is connected to the hook of the support case.

6. The accelerator device according to claim 1, wherein the return spring is a compression spring, a recess for holding one end of the return spring is formed in an inner surface of the support case, the first end of the friction piece is integrally formed with an arm, the arm is formed with a recess for holding the other end of the return spring, and the one end of the return spring is held in the recess of the support case and the other end of the return spring is held in the recess of the arm.

7. The accelerator device according to claim 1, wherein one of the friction piece and the friction part is made of materials including glass-fiber reinforced resin (PA46) and the other is made of materials including POM (polyoxymethylene).

8. The accelerator device according to claim 1, wherein one of the friction pieces and the friction part is made of materials including glass-fiber reinforced resin (PA46) and the other is made of materials including POM (polyoxymethylene).

9. An accelerator device, including:

an accelerator arm including a tip part, a base part, and an accelerator pedal at the tip part;

a support case internally holding and supporting the base part of the accelerator arm so that the base part is rotatable about a support shaft, the accelerator arm being supported to be rotatable together with the accelerator pedal between an initial position and a full open position in association with the rotation of the base part;

a return spring for urging the accelerator arm to rotate in a returning direction to return the accelerator pedal to the initial position;

an accelerator sensor for detecting a rotation amount of the accelerator arm as an accelerator opening degree; and a friction part provided in the support case and including a contacted surface;

a friction piece including a first end, a second end, and a contact surface provided between the first and second ends, the friction piece being attached at the first end to the base part of the accelerator arm while holding the contact surface in contact with the contacted surface so that friction is caused therebetween, the return spring being connected to the second end of the friction piece to press the contact surface against the contacted surface, wherein the contacted surface of the friction part is formed in an arcuate shape about the support shaft, the contact surface of the friction piece is formed in an arcuate shape with a diameter equal to that of the contacted surface of the friction part, and the friction piece is disposed so that the contact surface circumscribes the contacted surface, rotation of the accelerator arm causes the friction piece as well as the base part to rotate, thereby sliding the contact surface of the friction piece on the contacted surface of the friction part to produce pedal force hysteresis between a depressing side and a returning side of the accelerator pedal, the return spring is a tension spring, a hook for connecting the return spring to the support case is formed in the support case, the friction piece is formed at the second end thereof with a hook, and one end of the return spring is connected to the hook of the friction piece and the other end of the return spring is connected to the hook of the support case.

* * * * *